United States Patent [19]

Baker

[11] Patent Number: 4,762,097

[45] Date of Patent: Aug. 9, 1988

[54] ENGINE WITH HYDRAULICALLY VARIABLE CAM TIMING

[75] Inventor: Steven F. Baker, Bellevue, Ohio

[73] Assignee: General Motors Corporation, Detroit, Mich.

[21] Appl. No.: 946,992

[22] Filed: Dec. 29, 1986

[51] Int. Cl.[4] ..... F01L 1/34

[52] U.S. Cl. ..... 123/90.31; 123/90.17

[58] Field of Search ..... 123/90.15, 90.16, 90.17, 123/90.12, 90.31

[56] References Cited

U.S. PATENT DOCUMENTS

| | | | |
|---|---|---|---|
| 2,281,883 | 5/1942 | Kosian | 123/90.17 |
| 3,262,435 | 7/1966 | Cribbs | 123/90.15 |
| 4,091,776 | 5/1978 | Clemens et al. | 123/90.15 |
| 4,177,773 | 12/1979 | Cribbs | 123/90.15 |
| 4,545,338 | 10/1985 | Allred | 123/90.15 |
| 4,627,825 | 12/1986 | Bruss et al. | 123/90.15 |

FOREIGN PATENT DOCUMENTS

| | | | |
|---|---|---|---|
| 37616 | 3/1977 | Japan | 123/90.15 |
| 96311 | 7/1980 | Japan | 123/90.15 |

*Primary Examiner*—Willis R. Wolfe, Jr.
*Assistant Examiner*—M. Macy
*Attorney, Agent, or Firm*—Robert J. Outland

[57] ABSTRACT

An internal combustion engine, or the like, includes a camshaft drive providing hydraulically variable cam timing utilizing computer control of a hydraulic dump and fill coupling which varies the retardation of a spring driven member connected with the camshaft. The camshaft phase relation is read by the computer and adjusted in relation to engine speed according to a preprogrammed phase relationship.

4 Claims, 3 Drawing Sheets

ENGINE WITH HYDRAULICALLY VARIABLE CAM TIMING

TECHNICAL FIELD

This invention relates to internal combustion engines and camshaft drives therefore. More particularly the invention pertains to variable timing camshaft drives with means for hydraulically adjusting the phase angle of the cam or camshaft.

BACKGROUND

It is common in the art relating to internal combustion engines to drive a cam or camshaft through suitable means such as gear, chain or belt drives from the engine output means, or crankshaft, with a fixed speed ratio and phase relation between the driven camshaft and the driving crankshaft. However, numerous variable timing drive arrangements have also been proposed wherein the phase angle between the camshaft and the crankshaft may be varied manually or automatically during engine operation. In this way, variable timing of the engine valves may be provided.

Among various arrangements that have been previously proposed are the spring driven mechanical mechanisms of U.S. Pat. Nos. 3,262,435 Cribbs and 4,177,773 Cribbs and the hydraulic fluid actuated mechanism of 4,091,776 Clemens et al.

SUMMARY OF THE INVENTION

The present invention combines the concept of a spring drive with a hydraulic retarder controlled by phase control means to provide a desired variation in the crankshaft to camshaft phase relation.

In a preferred embodiment the camshaft is driven by yieldable spring means between driving and driven members of the drive train. The driven member is variably coupled with the housing through a drain and fill hydraulic coupling to provide variable retardation of the driven member and thereby variable timing and phase relation of the camshaft relative to the crankshaft from which it is driven. Computer controlled solenoid valves drain and fill the coupling in response to indicated phase relation and engine speed in order to carry out a predetermined program of camshaft advance (retard) versus engine speed. Of course, other suitable control means and phase relation programs could be utilized if desired.

These and other features and advantages of the invention will be more fully understood from the following description of a specific embodiment of the invention taken together with the accompanying drawings.

BRIEF DRAWING DESCRIPTION

DETAILED DESCRIPTION

Figure 1:
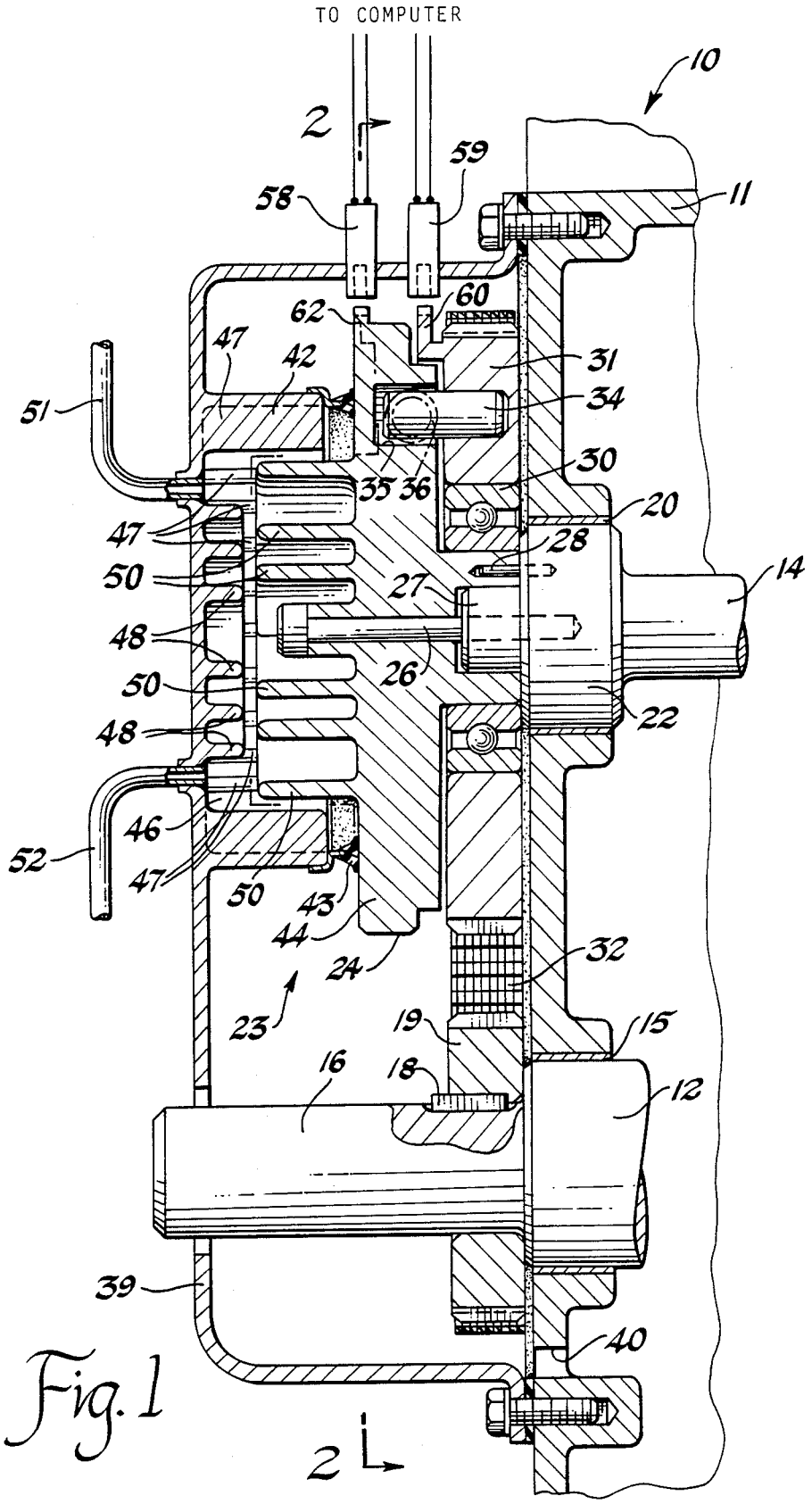
FIG. 1 is a longitudinal cross-sectional view of the camshaft drive front end portion of an internal combustion engine having hydraulically variable camshaft timing means in accordance with the invention.

Referring now to the drawings in detail, numeral 10 generally indicates an internal combustion engine having the usual crankcase or cylinder block 11 in which there is conventionally mounted a crankshaft 12 and a camshaft 14 spaced for rotation on parallel axes.

The crankshaft is rotatably supported in the crankcase 11 by bearings 15 and includes a driving stub 16 at one end, on which there is driven, by a key 18 or the like, a camshaft drive gear 19.

The camshaft 14 is similarly carried in bearings 20 of the crankcase and is connected at a front bearing journal 22 with variable timing means generally indicated by numeral 23.

The timing means includes a driven element 24 secured by a screw 26 to the camshaft journal 22 in a position centered by a hub 27 and oriented in a predetermined phase by a dowel pin 28.

The driven element carries a bearing 30 on which is rotatably mounted a drive member 31 comprising a gear having a toothed exterior and connected with and driven by the drive gear 19 through an associated drive chain 32. As is conventional in four stroke cycle engines, the ratio of the cam driving gears is 2:1 so that the camshaft gear drive member 31 makes one revolution for every two revolutions of the crankshaft 12 and its drive gear 19.

The drive member 31 carries a plurality of drive pins 34, three being shown. The drive pins extend longitudinally into recesses 35 in the driven element 24 where they engage yieldable coil springs 36. The springs bear on one end against their respective drive pins 34 and on their other ends against flattened ends 38 of the driven element recesses 35.

The timing means 23 are enclosed by a cover 39 which is mounted on the front end of the engine crankcase or block 11 and encloses the gear and chain driving mechanism. A drain opening 40 is provided in the block near the bottom of the cover for returning to the engine sump, not shown, lubricating oil supplied to the mechanism through means, not shown.

Longitudinally opposite the driven element 24, the cover 39 is provided with a cylindrical extension 42. On its inner end, a seal 43 engages an opposite face 44 of the driven element to define therewith an interior chamber 46 in which lubricating oil, or other fluid if desired, may be contained. Within the extension 42 there are provided radial vanes 47 spacedly located around the periphery of the chamber 46. Axially of the camshaft and its connected driven element 24, the housing is provided with longitudinally extending directing vanes 48 which extend into opposition with pumping vanes 50 protruding axially from the distal end of the driven element 24.

The chamber 46 is connected with an inlet conduit 51 extending through the cover 39 near the top of the chamber and an outlet conduit 52 extending through the cover 39 near the bottom of the chamber 46.

Figure 3:
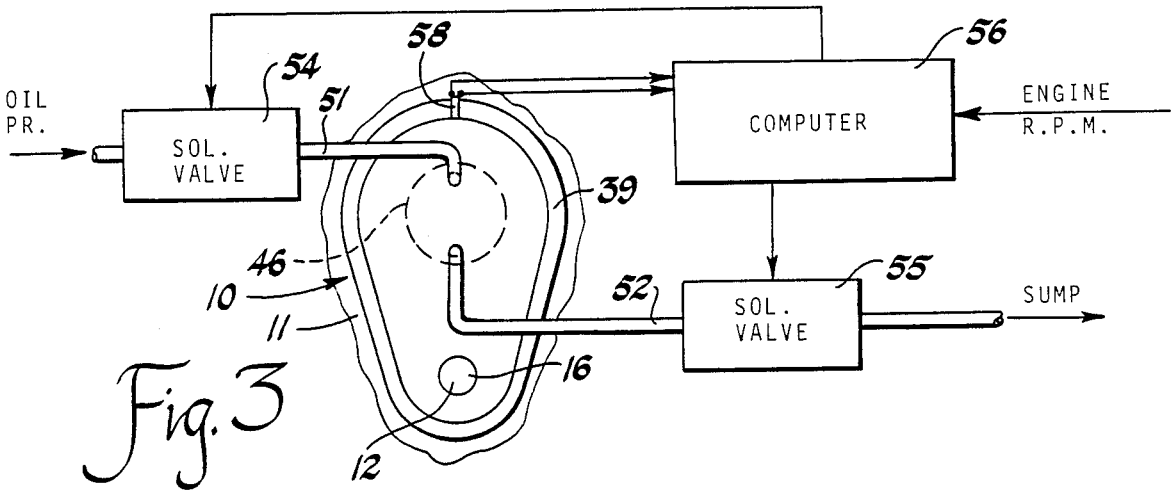
FIG. 3 is a schematic view illustrating computer control of the hydraulic fill and dump means of the variable timing mechanism.

As illustrated in FIG. 3, the inlet conduit 51 connects through a solenoid valve 54 with the pressurized engine oil supply while the outlet conduit 52 connects through a solenoid valve 55 with the engine oil sump, not shown. A computer 56, responsive to engine rpm and to the phase angle between the drive member 31 and the driven element 24 connects with both the solenoid valves 54 and 55 for controlling their operation.

The camshaft phase angle is indicated by sensors 58, 59 carried in the cover 39 and extending into opposed relation with timing lugs 60, 62 carried by the driving and driven elements 31, 24 respectively. The signals from the sensors 58, 59 are fed to the computer for computation of the phase relation of the driving and driven elements which determines the camshaft phase angle.

Figure 4:
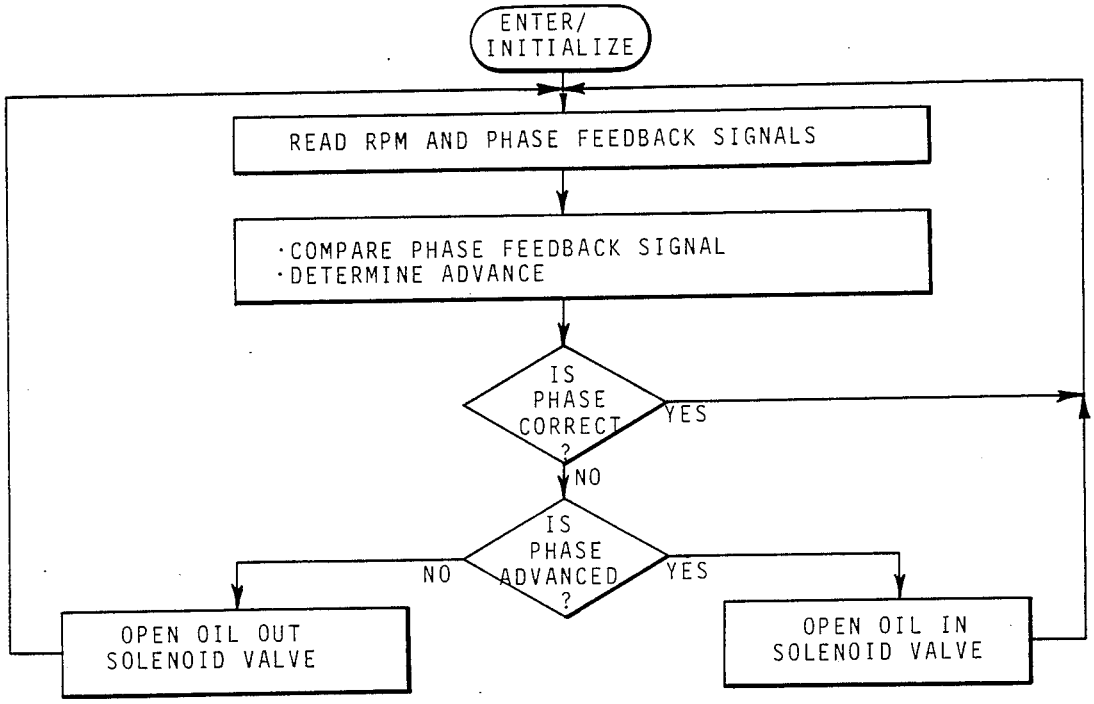
FIG. 4 is an exemplary flow diagram for the controlling computer.
Figure 5:
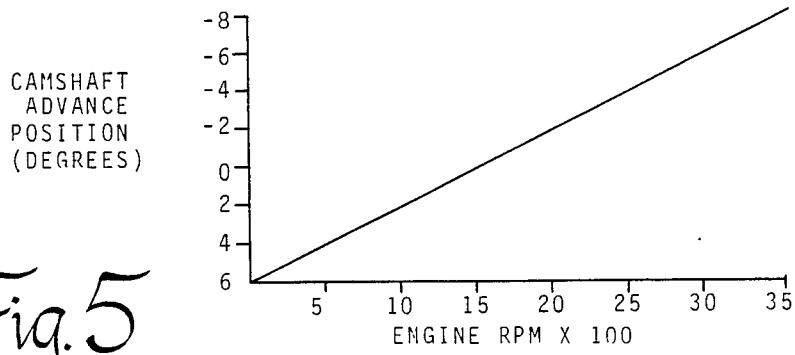
FIG. 5 is an exemplary graph of camshaft to crankshaft phase relation versus engine speed which may be incorporated in the program of the controlling computer.

In operation of the engine and its associated timing means, as illustrated in part by FIGS. 4 and 5, rotation of the crankshaft 12 drives the gear 19 and, through the chain 32, the driven member 31 at a speed ratio of 2:1. The driven member 31, acting through pins 34 on springs 36, rotatably drives the driven element 24.

Figure 2:
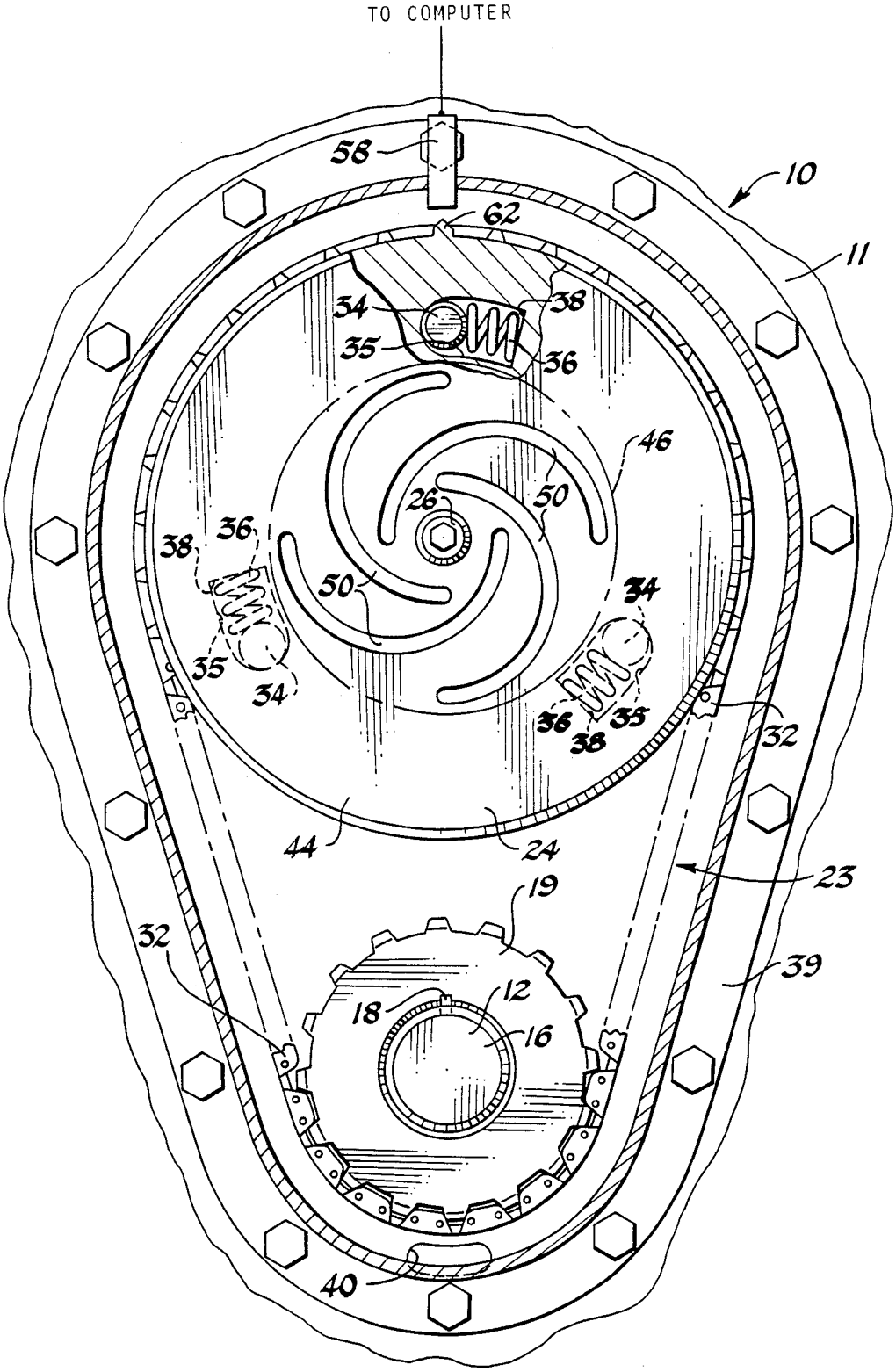
FIG. 2 is a transverse cross-sectional view from the plane indicated by the line 2—2 of FIG. 1.

The compressive load on the springs 36 is preset such that under normal operation the springs are fully extended, maintaining the phase angle of the driven element 24 and its attached camshaft 14 at the farthest advanced position with the pins 34 against the ends of the recesses 35 as shown in FIG. 2. As the engine speed rises above the idle condition, the timing is retarded by the control mechanism in accordance with the chart indicated in FIG. 5, which is programmed into the computer 56.

As the mechanism rotates, the phase indications picked up by sensors 58, 59 and a separately supplied engine speed signal are read by the computer. The computer then determines the phase angle between the elements 24, 31 and compares it with the proper phase angle for that engine speed as found in its program and indicated on the chart of FIG. 5. If the phase angle is correct, no action is taken as the flow diagram of FIG. 4 indicates. If the phase angle is not correct, the computer then determines whether it is advanced or retarded. If the phase is advanced, the computer actuates solenoid 54 to deliver oil from the engine pressure system into the chamber 46. The oil in the chamber is pumped by the pumping vanes 50 on the driven element 24 against the radial vanes 47 and directing vanes 48 mounted on the cover within the cavity 46. This causes a retarding reaction against the pumping vanes 50, which acts against rotation of the driven element 24. This compresses the springs 36 and retards the phase of the camshaft 14 with respect to the crankshaft 12 until the phase angle is correct and the solenoid valve 51 is closed. If, due to a change of engine speed or other reason, the camshaft phase angle is subsequently excessively retarded, the computer actuates the solenoid valve 55 allowing lubricating oil to drain out of the chamber 46 until the hydraulic retarding action of the vanes 47, 48, 50 is sufficiently reduced to allow the springs 36 to advance the camshaft phase to the proper position, at which time the solenoid valve 55 is again closed.

Thus, in the illustrated embodiment, the invention utilizes a dump and fill hydraulic coupling having vanes 47, 48, 50 to retard the phase angle of the driven element 24, and therefore the camshaft connected therewith. The dumping and filling of lubricating oil into the chamber 46 of the hydraulic coupling is under control of the computer 56 which is responsive to the engine speed and phase indications sensed by sensors 58, 59. In this way, positive phase location control of the camshaft in accordance with the desired preprogrammed relationship of engine speed with camshaft advance position is assured during all engine operating conditions.

While the invention has been described by reference to a preferred embodiment, it should be understood that numerous changes could be made within the spirit and scope of the inventive concepts described. Accordingly it is intended that the invention not be limited to the disclosed embodiment, but that it have the full scope permitted by the language of the following claims.

The embodiments of the invention in which an exclusive property or privilege is claimed are defined as follows:

1. Cam timing control means in combination with an internal combustion engine having a housing supporting a rotatable output member, a cam, and drive means between the output member and the cam to drive the cam at a rotational speed related to that of the output member, said cam timing control means comprising a drive member and a driven member forming a part of the drive means, said drive member being positively connected with the output member for direct rotation therewith and said driven member being positively connected with the cam for direct rotation therewith, resileintly yieldable means drivably connecting the drive and driven members and resiliently yieldable in response to variable drive resisting torque applied to the driven member to allow proportional retarding of the phase relation of the cam with respect to the output member, and fluid coupling means operatively connected between the driven member and the housing and controllable to apply a variable fluid drag on the driven member to create variable amounts of drive resisting torque for the control of cam timing.

2. Cam timing control means in combination with an internal combustion engine having a housing supporting a crankshaft, a camshaft, and drive means between the crankshaft and the camshaft to drive the camshaft at a rotational speed related to that of the crankshaft, said cam timing control means comprising a drive member and a driven member forming a part of the drive means, said drive member being positively connected with the crankshaft for direct rotation therewith and said driven member being positively connected with the camshaft for direct rotation therewith, resiliently yieldable means drivably connecting the drive and driven members and resiliently yieldable in response to variable drive resisting torque applied to the driven member to allow proportional retarding of the phase relation of the camshaft with respect to the crankshaft, and fluid coupling means operatively connected between the driven member and the housing and controllable to apply a variable fluid drag on the driven member to create variable amounts of drive resisting torque for the control of camshaft timing.

3. A combination as in claim 2 wherein said fluid coupling means includes fluid reaction vanes on the driven member and on the housing and contained within a cavity at least partially defined by the housing, and fluid supply and exhaust means connecting with the cavity, and said cam timing control means further includes means for sensing the phase relation of the cam relative to the crankshaft and means for selectively supplying fluid to and exhausting fluid from the cavity to vary the camshaft timing in response to a predetermined schedule.

4. A combination as in claim 3 wherein said predetermined schedule relates the camshaft phase angle to crankshaft speed and said cam timing and control means further includes means to provide signals indicative of the crankshaft and camshaft phase angles and the crankshaft speed for actuating said fluid supplying and exhausting means in accordance with said schedule.

* * * * *